US008025066B2

(12) United States Patent
Silva

(10) Patent No.: US 8,025,066 B2
(45) Date of Patent: Sep. 27, 2011

(54) ABSORBENT FABRIC COVERED HAIR CLIP

(76) Inventor: David Alan Silva, Reno, NV (US)

( * ) Notice: Subject to any disclaimer, the term of this patent is extended or adjusted under 35 U.S.C. 154(b) by 593 days.

(21) Appl. No.: 12/148,327

(22) Filed: Apr. 19, 2008

(65) Prior Publication Data

US 2008/0257371 A1 Oct. 23, 2008

Related U.S. Application Data

(60) Provisional application No. 60/925,434, filed on Apr. 20, 2007.

(51) Int. Cl.
*A45D 7/00* (2006.01)

(52) U.S. Cl. ..... 132/210

(58) Field of Classification Search ..... 132/273, 132/275–284, 210, 200, 212, 222, 56, 223–224; 2/207

See application file for complete search history.

(56) References Cited

U.S. PATENT DOCUMENTS 5,975,092 A * 11/1999 Tsai ..... 132/275
6,199,558 B1 * 3/2001 Schmidt et al. ..... 132/211
7,806,124 B2 * 10/2010 Mackinder ..... 132/233

* cited by examiner

*Primary Examiner* — Todd E Manahan
*Assistant Examiner* — Brianne O'Neill

(57) ABSTRACT

A method and tool for quickly drying and styling hair into a waved formation comprising an absorbent fabric covered hair clip that is secured about a plurality of scrunched sections of wet or damp hair. The absorbent material dries the hair more quickly by absorbing some of the moisture from the hair, the jaws help squeeze the moisture from the hair into the absorbent material covering, the softness of the absorbent material covering keeps the more rigid jaws from crimping the hair while drying, resulting in smooth continuous waves or curl.

4 Claims, 2 Drawing Sheets

ABSORBENT FABRIC COVERED HAIR CLIP

RELATED APPLICATION DATA

The present application is a non-provisional application based on, and claiming the priority benefit of provisional application Ser. No. 60/925,434, which was filed on Apr. 20, 2007, and is expressly incorporated herein by reference.

1. Field of the Invention

The present invention relates to a hair wave clip and method of curling or creating wave in hair. More particularly a claw clip covered with an absorbent material such as cotton, micro-fiber, or terrycloth.

2. Background of the Invention

One way to curl or wave hair is to use a standard spring and hinge clip. The user usually clamps it to finger formed waves to hold the wave in place until dry. The problem with this technique is that the clips hard surface crimps some of the hair, which disrupts the wave pattern by forming a kink. The clips also hold the hair sections tightly, which make it difficult to dry the hair that is within the clip. Further, the user runs the risk of the spring heating up, if a hairdryer is used, and burning or melting the hair if it comes in contact with the hair.

It is thus an object of the present invention to provide an improved hair wave clip.

SUMMARY OF THE PRESENT INVENTION

The current invention comprises a plurality of traditional 'butterfly' hair clips covered with an absorbent fabric. The fabric-covered clips are clamped to sections of scrunched hair. Wherein the hair is either air dried or dried with a hair-dryer. The clip holds the scrunched hair so the bends and waves created from scrunching the hair dry in the waved position. The soft fabric keeps the hair from crimping, resulting in a smooth natural looking wave or curl and it covers the metal spring, which keeps it from damaging the hair when the hair dryer heats the spring enough to melt the hair. Most importantly, the fabric absorbs moisture from the hair which helps dry it in a more timely fashion.

An object of the present invention is to provide an instrument, which is convenient, practical, and inexpensive for use in curling or waving hair.

A further object is to provide an instrument that will keep a hair clip from crimping hair while the hair is drying.

A further object is to provide a hair clip that is covered with an absorbent material to dry scrunched hair in a more timely fashion.

A further object is to provide an instrument that can be reused over and over again.

A further object is to provide an instrument that will quickly hold the user's hair in a scrunched position.

A further object is to provide a hair clip with an outer covering that covers the clip spring so the metal won't damage the hair when heated up.

A further object is to provide a hair clip with an outer absorbent covering that is removably connected so the covering can be washed.

According to the preferred embodiment of the present invention, there is provided a hair clip comprising two arced jaw members having gripping teeth and is joined along a pivot axis creating a hinge. The jaws are fed through a tube of material to cover all the clip but the teeth. Because the fabric is a tube it stays secured to the claw without needing any fastening means and can be easily removed to wash.

The material tube ends can also be secured by gluing them to the clip where the gripping teeth begin, by sewing them to the clip around the teeth, or by using snaps (so the fabric ends removably snap to the clip).

In use, hair sections are scrunched by the user's hand and a plurality of the clips, are secured to the plurality of scrunched hair sections. When the hair is dry the clips are removed to reveal curly or wavy hair.

Other objects, features and advantages of the present invention will become apparent from the following description of the preferred embodiments given with reference to the accompanying drawings.

DETAILED DESCRIPTION OF THE PREFERRED EMBODIMENTS

Figure 1:
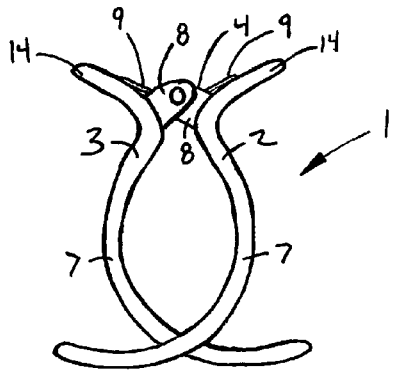
FIG. 1 is a side view without the absorbent covering.
Figure 3:
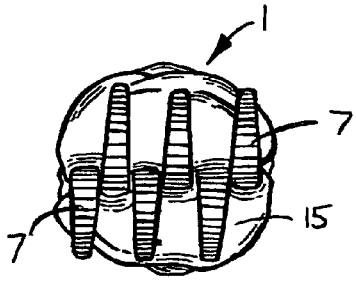
FIG. 3 is a bottom side view according to the present invention.
Figure 2:
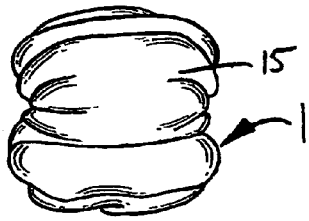
FIG. 2 is a top view according to the present invention.
Figure 4:
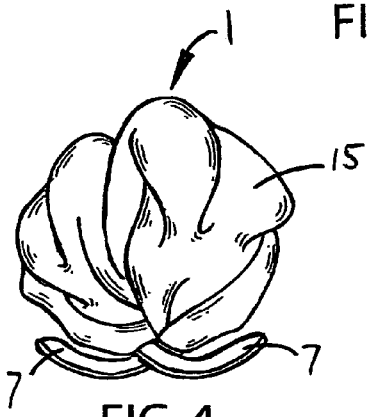
FIG. 4 is a side view according to the present invention.
Figure 5:
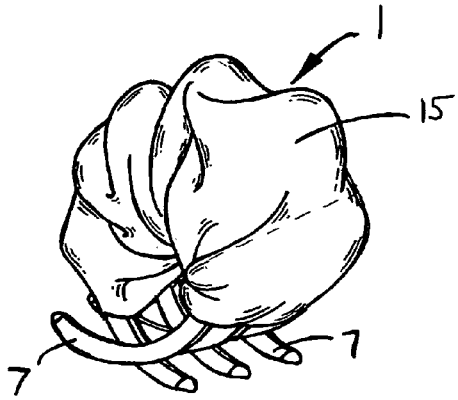
FIG. 5 is a plan view according to the present invention.

Referring to FIG. 1 of the accompanying drawings, there is illustrated the hair wave clip embodying the present invention without its absorbent cover. The invention, generally designated by reference numeral 1 has two jaws 2 and 3 bent in a direction away from the clip pivot 4 in a concave since. Each jaw 1 and 2 has tines or teeth 7, and lugs 8. The lugs 8 are aligned with a pin 10 placed through holes 11 in lugs 8 and a spring 9, which create the pivot 4. Each jaw has a lever 14. Preferably the jaws 2 and 3 are made of plastic. FIG. 2 through 5 show the absorbent material 15 covering the clip 1.

Figure 6:
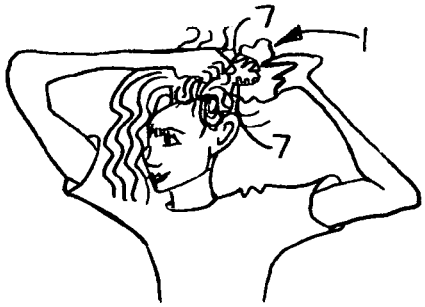
FIG. 6 is a schematic view of the current invention being clamped to the user's hair.
Figure 7:
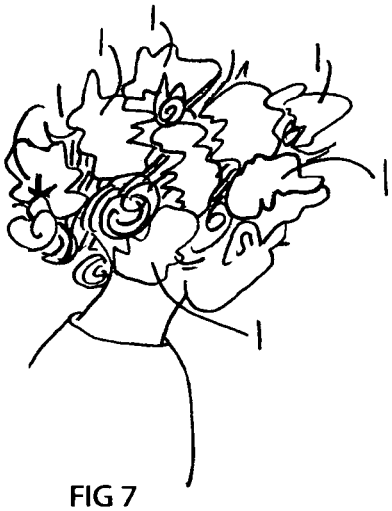
FIG. 7 is a schematic view of the current invention clamped to the user's hair.
Figure 8:
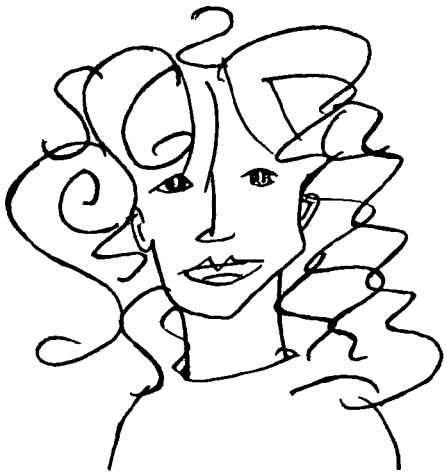
FIG. 8 is an after shot of the waved hair, after the current invention was removed from the hair.

In use FIG. 6 through 8 the clips 1 are clamped to sections of scrunched hair and removed after the hair is dry.

Although the present invention has been described with reference to specific embodiments, it will be apparent to a skilled person in the art that modifications lie within the spirit and scope of the present invention.

I claim:

1. A method of quickly drying and styling hair into a waved formation comprising the steps of: selecting an absorbent fabric covered hair clip wherein the absorbent fabric covered hair clip comprising a claw clip and an absorbent material covering: the claw clip having two jaw portions arched in a concave sense; said jaw portions having tines and being hingedly and resiliently connected together to urge said tines together for gripping hair, wherein said jaw portions are connected along a center axis, said jaw opening and closing arrangement comprises at least one spring means which urge the tines together; said claw clip also comprises a pair of handles disposed on the end of the jaws remote from the tines; said absorbent material covering is an absorbent fabric secured substantially around said claw clip, leaving only said gripping teeth uncovered by the absorbent material covering; grasping and scrunching a section of wet or damp hair; opening said absorbent fabric covered hair clip by pressing the handles together; closing said absorbent fabric covered hair clip about the scrunched section of wet or damp hair by releasing the handles; removing the absorbent fabric covered claw clip when the scrunched hair section is substantially dry; whereby, the absorbent material covering dries the hair more quickly by absorbing some of the moisture from the hair, the jaws help squeeze the moisture from the hair into the absorbent material covering, the softness of the absorbent material covering keeps the more rigid jaws from crimping the hair while drying, resulting in smooth continuous waves or curls.

2. The method of claim 1 wherein said absorbent material covering is a tube with a first open end and a second open end; said tube is attached to said claw clip by pressing the claw clip handles together to open the claw clip; feeding said tube onto said claw clip by placing the first open end of the tube onto one of said claw clip jaws starting at said gripping teeth; feeding said tube over the first said jaw, over said spring means, over said handles, over the edge of the second jaw, leaving the gripping teeth from the second jaw uncovered, and pushing said second side of the tube up until the gripping teeth from the first said jaw are uncovered.

3. The method of claim 1 wherein the absorbent material covering is removably connected to the claw clip.

4. The method of claim 1 wherein a plurality of absorbent fabric covered hair clips are each attached to a separate scrunched hair section.

* * * * *